US008119318B2

(12) United States Patent
Yoshie et al.

(10) Patent No.: US 8,119,318 B2
(45) Date of Patent: Feb. 21, 2012

(54) WET DEVELOPER

(75) Inventors: Naoki Yoshie, Ibaraki (JP); Keyaki Yogome, Otsu (JP); Chiaki Yamada, Ibaraki (JP)

(73) Assignee: Konica Minolta Business Technologies, Inc. (JP)

( * ) Notice: Subject to any disclaimer, the term of this patent is extended or adjusted under 35 U.S.C. 154(b) by 500 days.

(21) Appl. No.: 12/414,807

(22) Filed: Mar. 31, 2009

(65) Prior Publication Data

US 2009/0253067 A1 Oct. 8, 2009

(30) Foreign Application Priority Data

Apr. 2, 2008 (JP) ..... 2008-095928
Sep. 8, 2008 (JP) ..... 2008-229347

(51) Int. Cl.
*G03G 9/13* (2006.01)

(52) U.S. Cl. ..... 430/119.1; 430/115

(58) Field of Classification Search ..... 430/119.1, 430/115
See application file for complete search history.

(56) References Cited

U.S. PATENT DOCUMENTS

2005/0003293 A1* 1/2005 Takano et al. ..... 430/115

FOREIGN PATENT DOCUMENTS

JP 10-282733 A 10/1998
JP 2001-100533 A 4/2001

* cited by examiner

*Primary Examiner* — Hoa Le
(74) *Attorney, Agent, or Firm* — Cantor Colburn LLP

(57) ABSTRACT

To provide a wet developer which is capable of improving fixability, while ensuring a sufficient heat-resistant storage property. The wet developer contains toner particles composed of a colorant and a binder resin, which are dispersed in a non-volatile carrier solution by using a dispersant. As the binder resin, a polyester resin, which has an alcohol component containing a mixture of an ethylene oxide adduct of bisphenol A and a propylene oxide adduct of bisphenol A, with a ratio thereof being 1:19 to 10:10 (weight ratio), is used.

5 Claims, 1 Drawing Sheet

WET DEVELOPER

This application is based on applications Nos. 2008-095928 and 2008-229347 filed in Japan, the contents of which are hereby incorporated by reference.

BACKGROUND OF THE INVENTION

The present invention relates to a wet developer for use in an image-forming apparatus using a wet electrophotographic system, such as a copying machine, a printer and a digital printing machine.

In an image-forming process of the electrophotographic system, in general, an electrostatic latent image is formed on an electrostatic latent-image supporting member such as a photosensitive member, for example, by exposing an image in association with a document image or image data thereto, and by developing this electrostatic latent image, a visible toner image is formed, and the toner image is transferred and fixed onto an image-recording medium so that a target image is obtained.

The developing system can be classified into a dry developing method and a wet developing method. In the dry developing method, a toner or a toner to which a carrier having a magnetic property or the like is added is used as the developer. In general, a toner, mainly composed of a pigment and a binder resin, to which a charge control agent, a conductivity control agent, a plasticizer, a release agent and the like are externally or internally added, if necessary, is used as a dry toner. In contrast, in the wet developing method, a wet developer, prepared by dispersing toner particles mainly composed of a pigment and a binder resin, a charge control agent, a dispersion stabilizer and the like in a dispersion medium (carrier solution) having an electric insulating property, is used. The toner particles to be used in the wet developer can be formed into fine particles because there is no fear that the particles might be scattered and released into the air, and those having an average particle size of sub-micron can be put into practical use. For this reason, the resulting advantages are that an image having high resolution can be obtained, superior gradation can be achieved, and the like. For example, Patent Document 1 (Japanese Patent Application Laid-Open Publication No. 10-282733) describes a wet developer containing a polyester resin as the binder resin, colorant fine particles having a volume-average particle size in a range from 1.5 to 5.0 μm and an electrically insulating solvent in which the colorant fine particles are dispersed.

Moreover, the wet developer, which is stored in a developer container, is applied onto a developer supporting member such as a developing roller, and allowed to develop an electrostatic latent image on an electrostatic latent-image supporting member, and the image is transferred onto a recording material through an intermediate transfer member, if necessary. It is necessary that the wet developer achieve both of transferring property and handling property. For this reason, for example, Patent Document 2 (Japanese Patent Application Laid-Open Publication No. 2001-100533) describes a method using a wet developer having a thixotropic property.

SUMMARY OF THE INVENTION

A highly insulating solvent is used as a carrier solution to be used for the wet developer, and, in particular, in order to ensure safety for the environment, a non-volatile solvent is used. However, when the non-volatile solvent is used, a problem arises in which, since the solvent remains even at the time of a fixing process, fixability is lowered. In contrast, in order to improve the fixability, it is necessary to reduce the amount of the remaining solvent, and for this purpose, it is effective to reduce the amount of a dispersant for use in the toner particles. However, reducing the amount of the dispersant causes the problem that a heat resistant storage property of the developer is lowered. For this reason, it is difficult that the conventional developer improves the fixability while maintaining a sufficient heat resistant storage property.

Therefore, an object of the present invention is to solve the above-mentioned problems, and consequently to provide a wet developer which can improve the fixability while ensuring a sufficient heat-resistant storage property.

In order to solve the above problems, the wet developer of the present invention is a wet developer including toner particles composed of at least a colorant and a binder resin, which are dispersed in a non-volatile carrier solution by using a dispersant, wherein the binder resin is a polyester resin having an alcohol component which contains a mixture of an ethylene oxide adduct of bisphenol A and a propylene oxide adduct of bisphenol A, with a ratio thereof being 1:19 to 10:10 (weight ratio).

Moreover, a viscosity ratio ($\eta_1/\eta_{1000}$) between viscosity $\eta_1$ at the time of a steady shear rate of 1 $sec^{-1}$ and viscosity $\eta_{1000}$ at the time of a steady shear rate of 1000 $sec^{-1}$ is preferably in a range from 10 to 10,000.

Moreover, the dispersant is preferably a polymer dispersant having a basic group. As the polymer dispersant, a polymer dispersant having at least one kind of basic group selected from the group consisting of an amide group, a methylol group, a pyridine group, a pyrrolidone group, an imidazole group, an imine group and an amino group can be used.

Moreover, the polyester resin preferably has a glass transition temperature (Tg) of 60° C. or more.

In accordance with the present invention, by using a polyester resin having an alcohol component composed of a mixture of an ethylene oxide adduct of bisphenol A and a propylene oxide adduct of bisphenol A, as the binder resin for the toner particles, it is possible to improve the fixability, while ensuring a sufficient heat-resistant storage property. That is, by using the above-mentioned mixture as the alcohol component, the density of a polymer skeleton is further increased and has a harder structure. For this reason, it is considered that the heat-resistant property of the binder resin is improved and the resin is hardly fused so that the heat-resistant storage property of the developer is improved. Moreover, it is considered that since the density of the polymer skeleton is increased, the carrier solution hardly permeates the inside of the toner particles, with the remaining carrier solution being reduced, so that it becomes possible to improve the fixability.

When the wet developer precipitates during a storing period, a sticky precipitate is generated, with the result that it tends to be very difficult that the wet developer is re-dispersed. When the amount of the sticky precipitate is small, the wet developer can be re-dispersed, when stirred strongly, to cause no problems; however, when a large amount of developer is stored, a large amount of the sticky precipitate is generated, with the result that an extremely hard matter like hard rubber is formed, making it very difficult to re-disperse the wet developer to cause a problem with a handling property. In contrast, in the present invention, since the wet developer is allowed to have a viscosity ratio ($\eta_1/\eta_{1000}$) between viscosity $\eta_1$ at the time of a steady shear rate of 1 $sec^{-1}$ and viscosity $\eta_{1000}$ at the time of a steady shear rate of 1000 $sec^{-1}$ in a range from 10 to 10,000, it becomes possible to improve a precipitation resistant property.

DETAILED DESCRIPTION OF THE PREFERRED EMBODIMENTS

Figure 1:
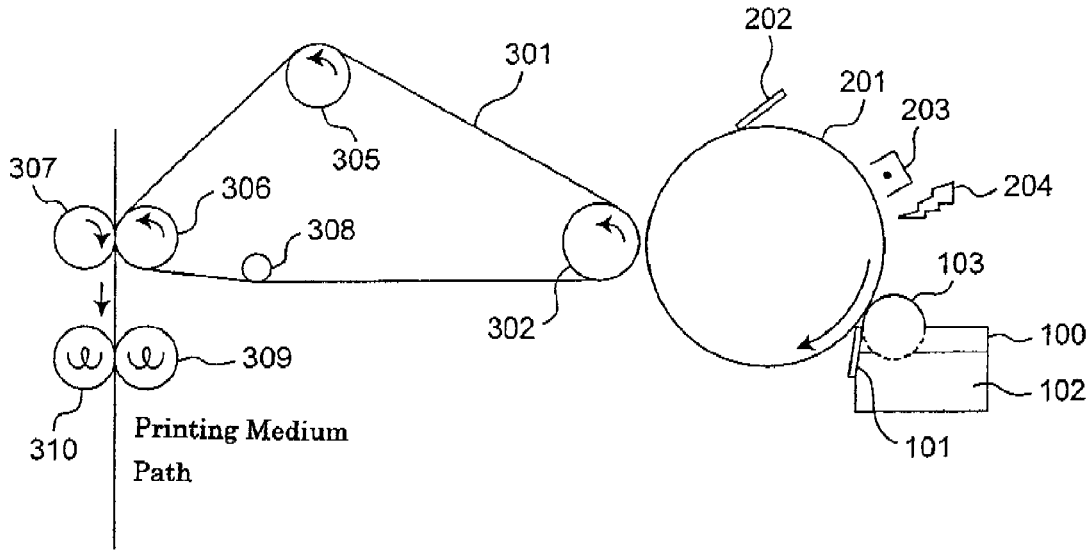
FIG. 1 is a schematic drawing showing one example of a structure of a wet image-forming apparatus.

Hereinbelow, an embodiment of the present invention will be described in detail.

The wet developer of the present invention relates to a wet developer having toner particles composed of at least a colorant and a binder resin, which are dispersed in a non-volatile carrier solution by using a dispersant, wherein the binder resin is a polyester resin having an alcohol component which contains a mixture of an ethylene oxide adduct of bisphenol A and a propylene oxide adduct of bisphenol A, with a ratio thereof being 1:19 to 10:10 (weight ratio).

The wet developer of the present invention contains at least a carrier solution, toner particles and a dispersant.

(Carrier Solution)

A non-volatile solvent having a high electric insulating property with a dielectric constant of 3 or less can be used as the carrier solution. For example, from the viewpoints of non-odor, non-toxicity and low costs, liquid paraffin, silicon oil, animal/vegetable oil, mineral oil or the like may be used, and liquid paraffin is preferably used. Examples of the liquid paraffin include MORESCO WHITE P-40 and P-70 made by Matsumura Oil Research Corporation, IP2028 and IP1620 made by Idemitsu Kosan Co., Ltd., ISOPAR-H, L and M made by Exxon Chemical Ltd. and the like. Here, in the present invention, the non-volatile solvent refers to a solvent having a flash point of 70° C. or more, unless otherwise indicated.

(Toner Particles)

The toner particles to be used in the present invention contain at least a colorant and a binder resin. A thermoplastic polyester resin is used as the binder resin The polyester resin has a sharp melting property so that it becomes possible to achieve both of storage stability and fixability.

More specifically, the polyester resin refers to a resin obtained by polycondensation between polybasic acid and polyhydric alcohol. Examples of the polybasic acid include such as isophthalic acid, terephthalic acid, malonic acid, succinic acid, adipic acid, azelaic acid, sebacic acid, fumaric acid, maleic acid, itaconic acid, and acid anhydrides thereof, as well as trimellitic acid, trimesic acid and pyromellitic acid. Preferably, isophthalic acid, terephthalic acid and trimellitic acid may be used.

A mixture of an ethylene oxide adduct of bisphenol A and a propylene oxide adduct of bisphenol A is used as the polyhydric alcohol. The mixed ratio thereof is from 1:19 to 10:10 in weight ratio. In a case where the mixed ratio is not more than the lower limit value, the heat-resistant storage stability deteriorates, and further the carrier solution is allowed to easily permeate the inside of the toner particles, that is, the carrier solution resistant property is lowered, with the result that the toner particles become to easily absorb the carrier solution to cause degradation of the fixability. Moreover, when the mixed ratio exceeds the upper limit value, the binder resin is hardly fused, thereby intervening with the fixing process.

The above-mentioned polybasic acids and polyhydric alcohol are subjected to a polycondensation process so that a desired polyester resin can be obtained. Any of conventionally known polycondensation methods may be used as the polycondensation method. The process is generally carried out at a temperature of about 150° C. to 300° C. although it depends on the kind of a material monomer.

Moreover, the process may be carried out under arbitrary conditions, such as using an inert gas as an ambient gas, using various kinds of solvents, or making the pressure of the reaction container at a normal pressure or at a reduced pressure. An esterifying catalyst may be used for accelerating the reaction. As the esterifying catalyst, metal organic compounds, such as tetrabutyl zirconate, zirconium naphthenate, tetrabutyl titanate, tetraoctyl titanate and 3/1 stannous oxalate/sodium acetate, or the like may be used; however, those in which the resulting product, ester, is not colored are preferably used. Moreover, alkyl phosphate, allyl phosphate or the like may be used as a catalyst or a hue-adjusting agent.

In order to control the molecular weight of the polyester resin as the resulting product, the polymerization temperature, the reaction system pressure, the reaction time and the like may be adjusted. Moreover, the acid value can be controlled by adjusting the molar ratio between carboxylic acid and alcohol to be reacted with each other, the molecular weight of the polymer and the like. The molecular weight is preferably 6000 or more, and more preferably 10000 or more, in the weight-average molecular weight (Mw). As the molecular weight becomes greater, the carrier solution resistant property is improved so that the fixability and the heat-resistant storage stability can be improved.

Any of conventionally known pigments and dyes may be used as the colorant for use in the developer of the present invention.

Specific examples thereof include such as Furnace Black, Lamp Black, Acetylene Black, Channel Black, C.I. Pigment Black, Ortho-Aniline Black, Toluidine Orange, Permanent Carmine FB, Fast Yellow AAA, Disazo Orange PMP, Lake Red C, Brilliant Carmine 6B, Phthalocyanine Blue, Quinaquridon Red, C.I. Pigment Blue, C.I. Pigment Red, C.I. Pigment Yellow, Dioxane Violet, Victoria Pure Blue, Alkali Blue Toner, Alkali Blue-R Toner, Fast Yellow 10G, Ortho-Nitro Aniline Orange, Toluidine Red, Barium Red 2B, Calcium Red 2B, Pigment Scarlet 3B Lake, Anthosin 3B Lake, Rhodamine 6B Lake, Methyl Violet Lake, Basic Blue 6B Lake, Fast Sky Blue, Reflex Blue G, Brilliant Green Lake, Phthalocyanine Green G, Prussian Blue, Ultramarine Blue, Iron Oxide Powder, Zinc White, calcium carbonate, Clay, barium sulfate, Alumina White, Aluminum Powder, daylight fluorescent pigment and pearl pigment.

Moreover, in order to improve dispersibility of the pigment, a colorant having a surface to which a functional group, such as a carboxylic group, a sulfonic acid group, a hydroxide group, an amino group and an amide group is added by surface treatment, surface modification or the like, may be used.

The compounding amount of the colorant is 3 to 50 parts by weight, and more preferably 5 to 30 parts by weight relative to 100 parts by weight of the binder resin. It is because when the amount is less than 3 parts by weight, a desired concentration is not obtained, and when it is greater than 50 parts by weight, the dispersibility and the fixability relating to the binder resin might be impaired.

(Dispersant)

In order to disperse toner particles in a carrier solution, a dispersant may be used. The dispersant is not particularly limited, and a polymer dispersant having metal soap and a basic group, or the like may be used, and a polymer dispersant having a basic group is preferably used. It is because by using this, it is possible to further improve the heat-resistant storage stability. Examples of the basic group include an aromatic amino group, an aliphatic amino group, a heterocyclic nitrogen-containing group, a heterocyclic oxygen-containing group and a heterocyclic sulfur-containing group. More specifically, a polymer dispersant having at least one kind of basic groups selected from the group consisting of an amide group, a methylol group, a pyridine group, a pyrrolidone group, an imidazole group, an imine group and an amino group may be used. Examples thereof include such as polyalkylene polyamine, a salt of long-chain polyamino-amide and a high-molecular weight acid ester, a salt of polyamino-amide and a polar acid ester, modified polyurethane, polyester polyamine, polyester polyimine and polyvinyl pyrrolidone. Preferably, polyester polyamine, polyester polyimine and polyvinyl pyrrolidone may be used.

Specific examples thereof include such as Anti-Terra-U (salt of polyamino-amide and an acid polymer), Anti-Terra-204 (salt of polyamino-amide and polycarboxylic acid), Disperbyk-101 (salt of polyamino-amide and a polar acid ester), Disperbyk-130 (unsaturated polycarboxylic acid polyamino-amide), and Disperbyk-109 (alkylol amino-amide), which are made by BYK Japan KK, Solsperse 19000 (polyester polyamine), Solsperse 13940 (polyester polyimine) and Solsperse 11200 (polyester polyimide), which are made by The Lubrizol Corporation, and V-216, V-220 (polyvinyl pyrrolidone), made by International Specialty Products.

Preferably, 1 to 100 parts by weight of the above-mentioned dispersant is added relative to 100 parts by weight of the toner particles. When the amount is less than 1 part by weight, the dispersibility is lowered, and when the amount is more than 100 parts by weight, the conductivity of the developing agent becomes higher, resulting in problems with the charging property.

(Production of Developer)

A colored kneaded matter composed of the above binder resin, the above colorant, and the like, is coarsely pulverized by using a cutter mill, a jet mill or the like so that a coarsely pulverized toner in which the colorant having its secondary particle size in a range from 50 nm to 1 μm, and preferably from 50 nm to 300 nm is dispersed is obtained. This coarsely pulverized toner is further subjected to a wet pulverizing process in a carrier solution containing a dispersant so that the toner particles are finely pulverized so as to have a volume-average particle size in a range from 0.1 to 10 μm, and preferably from 0.5 to 5 μm; thus, a thick wet developer is obtained. The thick wet developer thus obtained is further subjected to diluting and dispersing processes by using a carrier solution containing additives, such as a charge control agent, if necessary, so as to have an appropriate concentration so that a wet developer is obtained.

(Thixotropic Property)

The wet developer of the present invention has a thixotropic property, and the wet developer has a viscosity ratio ($\eta_1/\eta_{1000}$) between viscosity $\eta_1$ at the time of a steady shear rate of 1 $sec^{-1}$ and viscosity $\eta_{1000}$ at the time of a steady shear rate of 1000 $sec^{-1}$ in a range from 10 to 10,000. It is because the viscosity ratio of less than 10 tends to cause a precipitate, and the viscosity ratio of more than 10,000 makes it difficult to transport the developer solution. Preferably, the viscosity ratio is in a range from 20 to 1000.

Here, the thixo property refers to an abbreviation of thixotropic property that is a property in which a non-Newtonian substance exerts fluidity dependent on time so that apparent viscosity reduces with time at a fixed shear rate, and upon removal of a force causing a shear deformation, the apparent viscosity is gradually recovered. The viscosity, used in the present invention, refers to the apparent viscosity, which can be measured by using a rotation viscometer, such as a conical disc viscometer and a rotation conical viscometer.

In order to further improve the transferring property and handling property, the viscosity of the wet developer to be used in the present invention is not particularly limited, and viscosity at the time of steady shear rate of 1 $sec^{-1}$ is preferably 10 to 100,000 mPa·s, while viscosity at the time of a steady shear rate of 1000 $sec^{-1}$ is preferably 1 to 1,000 mPa·s.

Here, in the present invention, the polyester resin, which has an alcohol component having a mixed ratio between an ethylene oxide adduct of bisphenol A and a propylene oxide adduct of bisphenol A of 1:19 to 10:10 in weight ratio, is used as the binder resin, and this binder resin has not only a property for improving the heat-resistant storage property, but also a property for allowing the precipitate having been precipitated to be easily re-dispersed.

EXAMPLES

The present invention will be described more detail by way of the following examples; however, the present invention is not intended to be limited thereto. Here, in the following examples, the term "parts" refers to "parts by weight", the term "Mw" refers to "weight-average molecular weight", the term "Mn" refers to "number-average molecular weight" and the term "Tg" refers to "glass transition temperature", unless otherwise indicated.

In the following examples, Mw and Mn were respectively calculated from the results obtained by gel-permeation chromatography. The gel-permeation chromatography was carried out by using a high-speed liquid chromatograph pump TRI ROTAR-V-type (made by JASCO Corporation), an ultraviolet-ray spectroscopic detector UV IDEC-100-V-type (made by JASCO Corporation) and a column having a length of 50 cm, Shodex GPC A-803 (made by SHOWA DENKO K.K.), and based upon the results of the chromatography, the molecular weight of a test sample was found as Mw and Mn in terms of polystyrene. Here, a sample, prepared by dissolving 0.05 g of the binder resin in 20 ml of tetrahydrofran (THF), was used as the test sample.

Here, Tg was measured by using a differential scanning calorimeter DSC-20 (made by Seiko Instruments Inc.) under conditions of a sample amount of 35 mg and a temperature rise rate of 10° C./min. The acid value was measured in compliance with JIS K54000 method.

Production of Polyester Resin

Production Example 1

Into a round bottom flask equipped with a reflux condenser, a water/alcohol separation device, a nitrogen-gas introducing pipe, a thermometer and a stirring device, 1520 parts of a propylene oxide adduct of bisphenol A, 80 parts of an ethylene oxide adduct of bisphenol A and 850 parts of terephthalic acid were put, and to this was introduced a nitrogen gas, while being stirred, so that a dehydration polycondensating process or a dealcohol polycondensating process was carried out at a temperature of 200 to 240° C. At the time when the acid value of the resulting polyester resin or the viscosity of the reaction solution had become a predetermined value, the temperature of the reaction system was lowered to 100° C. or less to stop the polycondensating process. Thus, a thermoplastic polyester resin A was obtained.

The polyester resin A thus obtained had values of Mw of 9000, Mn of 2100, Tg of 68° C. and acid value of 12.0 mg KOH/g.

Production Example 2

Into a round bottom flask equipped with a reflux condenser, a water/alcohol separation device, a nitrogen-gas introducing pipe, a thermometer and a stirring device, 1380 parts of a propylene oxide adduct of bisphenol A, 220 parts of an ethylene oxide adduct of bisphenol A, 450 parts of terephthalic acid and 200 parts of trimellitic acid were put, and to this was introduced a nitrogen gas, while being stirred, so that a dehydration polycondensating process or a dealcohol polycondensating process was carried out at a temperature of 200 to 240° C. At the time when the acid value of the resulting polyester resin or the viscosity of the reaction solution had become a predetermined value, the temperature of the reaction system was lowered to 100° C. or less to stop the polycondensating process. Thus, a thermoplastic polyester resin B was obtained.

The polyester resin B thus obtained had values of Mw of 19000, Mn of 3300, Tg of 76° C. and acid value of 42.0 mg KOH/g.

Production Example 3

Into a round bottom flask equipped with a reflux condenser, a water/alcohol separation device, a nitrogen-gas introducing pipe, a thermometer and a stirring device, 1280 parts of a propylene oxide adduct of bisphenol A, 320 parts of an ethylene oxide adduct of bisphenol A, 600 parts of terephthalic acid and 50 parts of trimellitic acid were put, and to this was introduced a nitrogen gas, while being stirred, so that a dehydration polycondensating process or a dealcohol polycondensating process was carried out at a temperature of 200 to 240° C. At the time when the acid value of the resulting polyester resin or the viscosity of the reaction solution had become a predetermined value, the temperature of the reaction system was lowered to 100° C. or less to stop the polycondensating process. Thus, a thermoplastic polyester resin C was obtained.

The polyester resin C thus obtained had values of Mw of 14000, Mn of 3700, Tg of 78° C. and acid value of 27.0 mg KOH/g.

Production Example 4

Into a round bottom flask equipped with a reflux condenser, a water/alcohol separation device, a nitrogen-gas introducing pipe, a thermometer and a stirring device, 980 parts of a propylene oxide adduct of bisphenol A, 320 parts of an ethylene oxide adduct of bisphenol A and 890 parts of terephthalic acid were put, and to this was introduced a nitrogen gas, while being stirred, so that a dehydration polycondensating process or a dealcohol polycondensating process was carried out at a temperature of 200 to 240° C. At the time when the acid value of the resulting polyester resin or the viscosity of the reaction solution had become a predetermined value, the temperature of the reaction system was lowered to 100° C. or less to stop the polycondensating process. Thus, a thermoplastic polyester resin D was obtained.

The polyester resin D thus obtained had values of Mw of 12000, Mn of 3200, Tg of 78.3° C. and acid value of 7.0 mg KOH/g.

Production Example 5

Into a round bottom flask equipped with a reflux condenser, a water/alcohol separation device, a nitrogen-gas introducing pipe, a thermometer and a stirring device, 940 parts of a propylene oxide adduct of bisphenol A, 400 parts of an ethylene oxide adduct of bisphenol A and 800 parts of terephthalic acid were put, and to this was introduced a nitrogen gas, while being stirred, so that a dehydration polycondensating process or a dealcohol polycondensating process was carried out at a temperature of 200 to 240° C. At the time when the acid value of the resulting polyester resin or the viscosity of the reaction solution had become a predetermined value, the temperature of the reaction system was lowered to 100° C. or less to stop the polycondensating process. Thus, a thermoplastic polyester resin E was obtained.

The polyester resin E thus obtained had values of Mw of 11000, Mn of 3100, Tg of 68° C. and acid value of 22 mg KOH/g.

Production Example 6

Into a round bottom flask equipped with a reflux condenser, a water/alcohol separation device, a nitrogen-gas introducing pipe, a thermometer and a stirring device, 900 parts of a propylene oxide adduct of bisphenol A, 600 parts of an ethylene oxide adduct of bisphenol A and 950 parts of terephthalic acid were put, and to this was introduced a nitrogen gas, while being stirred, so that a dehydration polycondensating process or a dealcohol polycondensating process was carried out at a temperature of 200 to 240° C. At the time when the acid value of the resulting polyester resin or the viscosity of the reaction solution had become a predetermined value, the temperature of the reaction system was lowered to 100° C. or less to stop the polycondensating process. Thus, a thermoplastic polyester resin F was obtained.

The polyester resin F thus obtained had values of Mw of 12000, Mn of 3000, Tg of 79° C. and acid value of 38 mg KOH/g.

Production Example 7

Into a round bottom flask equipped with a reflux condenser, a water/alcohol separation device, a nitrogen-gas introducing pipe, a thermometer and a stirring device, 800 parts of a propylene oxide adduct of bisphenol A, 800 parts of an ethylene oxide adduct of bisphenol A and 890 parts of terephthalic acid were put, and to this was introduced a nitrogen gas, while being stirred, so that a dehydration polycondensating process or a dealcohol polycondensating process was carried out at a temperature of 200 to 240° C. At the time when the acid value of the resulting polyester resin or the viscosity of the reaction solution had become a predetermined value, the temperature of the reaction system was lowered to 100° C. or less to stop the polycondensating process. Thus, a thermoplastic polyester resin G was obtained.

The polyester resin G thus obtained had values of Mw of 7000, Mn of 2200, Tg of 68.3° C. and acid value of 7.0 mg KOH/g.

Production Example 8

Into a round bottom flask equipped with a reflux condenser, a water/alcohol separation device, a nitrogen-gas introducing pipe, a thermometer and a stirring device, 1600 parts of a propylene oxide adduct of bisphenol A and 850 parts of terephthalic acid were put, and to this was introduced a nitrogen gas, while being stirred, so that a dehydration polycondensating process or a dealcohol polycondensating process was carried out at a temperature of 200 to 240° C. At the time when the acid value of the resulting polyester resin or the viscosity of the reaction solution had become a predetermined value, the temperature of the reaction system was lowered to 100° C. or less to stop the polycondensating process. Thus, a thermoplastic polyester resin H was obtained.

The polyester resin H thus obtained had values of Mw of 9000, Mn of 3200, Tg of 55° C. and acid value of 8.0 mg KOH/g.

Production Example 9

Into a round bottom flask equipped with a reflux condenser, a water/alcohol separation device, a nitrogen-gas introducing pipe, a thermometer and a stirring device, 700 parts of a propylene oxide adduct of bisphenol A, 900 parts of an ethylene oxide adduct of bisphenol A and 850 parts of terephthalic acid were put, and to this was introduced a nitrogen gas, while being stirred, so that a dehydration polycondensating process or a dealcohol polycondensating process was carried out at a temperature of 200 to 240° C. At the time when the acid value of the resulting polyester resin or the viscosity of the reaction solution had become a predetermined value, the temperature of the reaction system was lowered to 100° C. or less to stop the polycondensating process. Thus, a thermoplastic polyester resin I was obtained.

The polyester resin I thus obtained had values of Mw of 14000, Mn of 3200, Tg of 81° C. and acid value of 8.0 mg KOH/g.

Production Example 10

Into a round bottom flask equipped with a reflux condenser, a water/alcohol separation device, a nitrogen-gas introducing pipe, a thermometer and a stirring device, 1570 parts of a propylene oxide adduct of bisphenol A, 30 parts of an ethylene oxide adduct of bisphenol A and 1000 parts of terephthalic acid were put, and to this was introduced a nitrogen gas, while being stirred, so that a dehydration polycondensating process or a dealcohol polycondensating process was carried out at a temperature of 200 to 240° C. At the time when the acid value of the resulting polyester resin or the viscosity of the reaction solution had become a predetermined value, the temperature of the reaction system was lowered to 100° C. or less to stop the polycondensating process. Thus, a thermoplastic polyester resin J was obtained.

The polyester resin J thus obtained had values of Mw of 8000, Mn of 3200, Tg of 81° C. and acid value of 28.0 mg KOH/g.

The physical property values of the polyester resins A to J obtained in Production Examples 1 to 10 are shown in Table 1. Here, a propylene oxide ratio (PO ratio) in the alcohol component is expressed % by weight at the tome of charging.

TABLE 1

| | Alcohol | | Acid | | PO ratio in | Characteristics | | | |
|---|---|---|---|---|---|---|---|---|---|
| Resin | PO (parts) | EO (parts) | TMA (parts) | TPA (parts) | alcohol component | Mn | Mw | Tg(° C.) | Acid value |
| A | 1520 | 80 | 0 | 850 | 95 | 2100 | 9000 | 68 | 12 |
| B | 1380 | 220 | 200 | 450 | 86.3 | 3300 | 19000 | 76 | 42 |
| C | 1280 | 320 | 50 | 600 | 80 | 3700 | 14000 | 78 | 27 |
| D | 980 | 320 | 0 | 890 | 75 | 3200 | 12000 | 78.3 | 7.0 |
| E | 940 | 400 | 0 | 800 | 70 | 3100 | 11000 | 68 | 22 |
| F | 900 | 600 | 0 | 950 | 60 | 3000 | 12000 | 79 | 38 |
| G | 800 | 800 | 0 | 890 | 50 | 2200 | 7000 | 68.3 | 7.0 |
| H | 1600 | 0 | 0 | 850 | 100 | 3200 | 9000 | 55 | 8.0 |
| I | 700 | 900 | 0 | 850 | 43.8 | 3200 | 14000 | 81 | 8.0 |
| J | 1570 | 30 | 0 | 1000 | 97.5 | 3200 | 8000 | 81 | 28 |

Production of Developer

Example 1

The polyester resin A (100 parts by weight) and copper phthalocyanine (15 parts by weight) were mixed, and further mixed by a Henschel mixer sufficiently, and after the mixture was melt-mixed by a twine-screw extrusion kneader, the resulting kneaded matter was cooled, and then coarsely pulverized. This was then finely pulverized by using a jet mill so that toner particles having an average particle size of 6 μm were obtained.

These toner particles (20 parts by weight), V-220 (made by International Specialty Products) (0.25 parts by weight) serving as a dispersant, liquid paraffin (100 parts by weight) (flashing point: 140° C., MORESCO WHITE P-40 (made by Matsumura Oil Research Corporation)) and zirconia beads (100 parts by weight) were mixed, and stirred by a sand mill for 120 hours so that a developer A was obtained. The average particle size of the toner particles in the developer A was 2.7 μm.

Example 2

The polyester resin C (100 parts by weight) and copper phthalocyanine (15 parts by weight) were mixed, and further mixed by a Henschel mixer sufficiently, and after the mixture was melt-mixed by a twine-screw extrusion kneader, the resulting kneaded matter was cooled, and then coarsely pulverized. This was then finely pulverized by using a jet mill so that toner particles having an average particle size of 6 μm were obtained.

These toner particles (20 parts by weight), V-220 (made by International Specialty Products) (0.25 parts by weight) serving as a dispersant, liquid paraffin (100 parts by weight) (flashing point: 84° C., IP 2028 (made by Idemitsu Kosan Co., Ltd.)) and zirconia beads (100 parts by weight) were mixed, and stirred by a sand mill for 120 hours so that a developer B was obtained. The average particle size of the toner particles in the developer B was 2.9 μm.

Example 3

The polyester resin F (100 parts by weight) and copper phthalocyanine (15 parts by weight) were mixed, and further mixed by a Henschel mixer sufficiently, and after the mixture was melt-mixed by a twine-screw extrusion kneader, the resulting kneaded matter was cooled, and then coarsely pulverized. This was then finely pulverized by using a jet mill so that toner particles having an average particle size of 6 μm were obtained.

These toner particles (20 parts by weight), Solsperse S11200 (0.25 parts by weight) serving as a dispersant, liquid paraffin (100 parts by weight) (flashing point: 140° C., MORESCO WHITE P-40 (made by Matsumura Oil Research Corporation)) and zirconia beads (100 parts by weight) were mixed, and stirred by a sand mill for 120 hours so that a developer C was obtained. The average particle size of the toner particles in the developer C was 2.7 μm.

Example 4

The polyester resin G (100 parts by weight) and copper phthalocyanine (15 parts by weight) were mixed, and further mixed by a Henschel mixer sufficiently, and after the mixture was melt-mixed by a twine-screw extrusion kneader, the resulting kneaded matter was cooled, and then coarsely pulverized. This was then finely pulverized by using a jet mill so that toner particles having an average particle size of 6 μm were obtained.

These toner particles (20 parts by weight), V-220 (made by International Specialty Products) (0.25 parts by weight) serving as a dispersant, liquid paraffin (100 parts by weight) (flashing point: 84° C., IP 2028 (made by Idemitsu Kosan Co., Ltd.)) and zirconia beads (100 parts by weight) were mixed, and stirred by a sand mill for 120 hours so that a developer D was obtained. The average particle size of the toner particles in the developer D was 2.5 μm.

Example 5

The polyester resin B (100 parts by weight) and copper phthalocyanine (15 parts by weight) were mixed, and further mixed by a Henschel mixer sufficiently, and after the mixture was melt-mixed by a twine-screw extrusion kneader, the resulting kneaded matter was cooled, and then coarsely pulverized. This was then finely pulverized by using a jet mill so that toner particles having an average particle size of 6 μm were obtained.

These toner particles (20 parts by weight), V-220 (made by International Specialty Products) (0.5 parts by weight) serving as a dispersant, liquid paraffin (100 parts by weight) (flashing point: 140° C., MORESCO WHITE P-40 (made by Matsumura Oil Research Corporation)) and zirconia beads (100 parts by weight) were mixed, and stirred by a sand mill for 120 hours so that a developer E was obtained. The average particle size of the toner particles in the developer E was 2.7 μm.

Example 6

The polyester resin E (100 parts by weight) and copper phthalocyanine (15 parts by weight) were mixed, and further mixed by a Henschel mixer sufficiently, and after the mixture was melt-mixed by a twine-screw extrusion kneader, the resulting kneaded matter was cooled, and then coarsely pulverized. This was then finely pulverized by using a jet mill so that toner particles having an average particle size of 6 μm were obtained.

These toner particles (20 parts by weight), Disperbyk-109 (made by BYK Japan KK) (0.5 parts by weight) serving as a dispersant, liquid paraffin (100 parts by weight) (flashing point: 84° C., IP 2028 (made by Idemitsu Kosan Co., Ltd.)) and zirconia beads (100 parts by weight) were mixed, and stirred by a sand mill for 120 hours so that a developer F was obtained. The average particle size of the toner particles in the developer F was 2.8 μm.

Example 7

The polyester resin G (100 parts by weight) and Carbon black (MA-100, made by Mitsubishi Chemical Corporation) (10 parts by weight) were mixed, and further mixed by a Henschel mixer sufficiently, and after the mixture was melt-mixed by a twine-screw extrusion kneader, the resulting kneaded matter was cooled, and then coarsely pulverized. This was then finely pulverized by using a jet mill so that toner particles having an average particle size of 6 μm were obtained.

These toner particles (25 parts by weight), V-220 (made by International Specialty Products) (0.5 parts by weight) serving as a dispersant, liquid paraffin (100 parts by weight) (flashing point: 140° C., MORESCO WHITE P-40 (made by Matsumura Oil Research Corporation)) and zirconia beads (100 parts by weight) were mixed, and stirred by a sand mill for 120 hours so that a developer G was obtained. The average particle size of the toner particles in the developer G was 2.6 μm.

Example 8

The polyester resin A (100 parts by weight) and copper phthalocyanine (15 parts by weight) were mixed, and further mixed by a Henschel mixer sufficiently, and after the mixture was melt-mixed by a twine-screw extrusion kneader, the resulting kneaded matter was cooled, and then coarsely pulverized. This was then finely pulverized by using a jet mill so that toner particles having an average particle size of 6 μm were obtained.

These toner particles (20 parts by weight), V-220 (made by International Specialty Products) (0.75 parts by weight) serving as a dispersant, liquid paraffin (100 parts by weight) (flashing point: 84° C., IP 2028 (made by Idemitsu Kosan Co., Ltd.)) and zirconia beads (100 parts by weight) were mixed, and stirred by a sand mill for 120 hours so that a developer H was obtained. The average particle size of the toner particles in the developer H was 2.8 μm.

Example 9

The polyester resin F (100 parts by weight) and copper phthalocyanine (15 parts by weight) were mixed, and further mixed by a Henschel mixer sufficiently, and after the mixture was melt-mixed by a twine-screw extrusion kneader, the resulting kneaded matter was cooled, and then coarsely pulverized. This was then finely pulverized by using a jet mill so that toner particles having an average particle size of 6 μm were obtained.

These toner particles (25 parts by weight), Solsperse S13940 (0.75 parts by weight) serving as a dispersant, liquid paraffin (100 parts by weight) (flashing point: 140° C., MORESCO WHITE P-40 (made by Matsumura Oil Research Corporation)) and zirconia beads (100 parts by weight) were mixed, and stirred by a sand mill for 120 hours so that a developer I was obtained. The average particle size of the toner particles in the developer I was 2.6 μm.

Example 10

The polyester resin G (100 parts by weight) and copper phthalocyanine (15 parts by weight) were mixed, and further mixed by a Henschel mixer sufficiently, and after the mixture was melt-mixed by a twine-screw extrusion kneader, the resulting kneaded matter was cooled, and then coarsely pulverized. This was then finely pulverized by using a jet mill so that toner particles having an average particle size of 6 μm were obtained.

These toner particles (20 parts by weight), V-220 (made by International Specialty Products) (1.5 parts by weight) serving as a dispersant, liquid paraffin (100 parts by weight) (flashing point: 84° C., IP 2028 (made by Idemitsu Kosan Co., Ltd.)) and zirconia beads (100 parts by weight) were mixed, and stirred by a sand mill for 120 hours so that a developer J was obtained. The average particle size of the toner particles in the developer J was 2.7 μm.

Example 11

The polyester resin B (100 parts by weight) and copper phthalocyanine subjected to basic treatment (17 parts by weight) were mixed, and further mixed by a Henschel mixer sufficiently, and after the mixture was melt-mixed by a twine-screw extrusion kneader, the resulting kneaded matter was cooled, and then coarsely pulverized. This was then finely pulverized by using a jet mill so that toner particles having an average particle size of 6 μm were obtained.

These toner particles (20 parts by weight), V-220 (made by International Specialty Products) (1.5 parts by weight) serving as a dispersant, liquid paraffin (100 parts by weight) (flashing point: 170° C., MORESCO WHITE P-60 (made by Matsumura Oil Research Corporation)) and zirconia beads (100 parts by weight) were mixed, and stirred by a sand mill for 120 hours so that a developer K was obtained. The average particle size of the toner particles in the developer K was 2.4 μm.

Example 12

The polyester resin G (100 parts by weight) and copper phthalocyanine (15 parts by weight) were mixed, and further mixed by a Henschel mixer sufficiently, and after the mixture was melt-mixed by a twine-screw extrusion kneader, the resulting kneaded matter was cooled, and then coarsely pulverized. This was then finely pulverized by using a jet mill so that toner particles having an average particle size of 6 μm were obtained.

These toner particles (25 parts by weight), Solsperse S13940 (2 parts by weight) serving as a dispersant, liquid paraffin (100 parts by weight) (flashing point: 200° C., MORESCO WHITE P-120 (made by Matsumura Oil Research Corporation)) and zirconia beads (100 parts by weight) were mixed, and stirred by a sand mill for 120 hours so that a developer L was obtained. The average particle size of the toner particles in the developer L was 2.6 μm.

Example 13

The polyester resin D (100 parts by weight) and Carbon black (MA-100, made by Mitsubishi Chemical Corporation) (10 parts by weight) were mixed, and further mixed by a Henschel mixer sufficiently, and after the mixture was melt-mixed by a twine-screw extrusion kneader, the resulting kneaded matter was cooled, and then coarsely pulverized. This was then finely pulverized by using a jet mill so that toner particles having an average particle size of 6 μm were obtained.

These toner particles (25 parts by weight), Solsperse S11200 (2 parts by weight) serving as a dispersant, liquid paraffin (100 parts by weight) (flashing point: 200° C., MORESCO WHITE P-120 (made by Matsumura Oil Research Corporation)) and zirconia beads (100 parts by weight) were mixed, and stirred by a sand mill for 120 hours so that a developer M was obtained. The average particle size of the toner particles in the developer M was 2.9 μm.

Example 14

The polyester resin C (100 parts by weight) and quinacridone (20 parts by weight) were mixed, and further mixed by a Henschel mixer sufficiently, and after the mixture was melt-mixed by a twine-screw extrusion kneader, the resulting kneaded matter was cooled, and then coarsely pulverized. This was then finely pulverized by using a jet mill so that toner particles having an average particle size of 6 μm were obtained.

These toner particles (25 parts by weight), Disperbyk-109 (made by BYK Japan KK) (2 parts by weight) serving as a dispersant, liquid paraffin (100 parts by weight) (flashing point: 140° C., MORESCO WHITE P-40 (made by Matsumura Oil Research Corporation)) and zirconia beads (100 parts by weight) were mixed, and stirred by a sand mill for 120 hours so that a developer N was obtained. The average particle size of the toner particles in the developer N was 3.1 μm.

Example 15

The same processes as those of example 12 were carried out except that in place of the polyester resin G, the polyester resin A was used so that a developer O was obtained. The average particle size of the toner particles in the developer O was 2.7 μm.

Example 16

The polyester resin B (100 parts by weight) and copper phthalocyanine (15 parts by weight) were mixed, and further mixed by a Henschel mixer sufficiently, and after the mixture was melt-mixed by a twine-screw extrusion kneader, the resulting kneaded matter was cooled, and then coarsely pulverized. This was then finely pulverized by using a jet mill so that toner particles having an average particle size of 6 μm were obtained.

These toner particles (20 parts by weight), V-220 (made by International Specialty Products)(4 parts by weight) serving as a dispersant, liquid paraffin (100 parts by weight) (flashing point: 140° C., MORESCO WHITE P-40 (made by Matsumura Oil Research Corporation)) and zirconia beads (100 parts by weight) were mixed, and stirred by a sand mill for 120 hours so that a developer P was obtained. The average particle size of the toner particles in the developer P was 2.8 μm.

Example 17

The polyester resin F (100 parts by weight) and Carbon black (MA-100, made by Mitsubishi Chemical Corporation) (10 parts by weight) were mixed, and further mixed by a Henschel mixer sufficiently, and after the mixture was melt-mixed by a twine-screw extrusion kneader, the resulting kneaded matter was cooled, and then coarsely pulverized. This was then finely pulverized by using a jet mill so that toner particles having an average particle size of 6 μm were obtained.

These toner particles (25 parts by weight), Solsperse S11200 (5 parts by weight) serving as a dispersant, liquid paraffin (100 parts by weight) (flashing point: 84° C., IP 2028 (made by Idemitsu Kosan Co., Ltd.)) and zirconia beads (100 parts by weight) were mixed, and stirred by a sand mill for 120 hours so that a developer Q was obtained. The average particle size of the toner particles in the developer Q was 2.6 μm.

Example 18

The polyester resin F (100 parts by weight) and copper phthalocyanine (15 parts by weight) were mixed, and further mixed by a Henschel mixer sufficiently, and after the mixture was melt-mixed by a twine-screw extrusion kneader, the resulting kneaded matter was cooled, and then coarsely pulverized. This was then finely pulverized by using a jet mill so that toner particles having an average particle size of 6 μm were obtained.

These toner particles (11 parts by weight), V-220 (made by International Specialty Products) (0.25 parts by weight) serving as a dispersant, liquid paraffin (100 parts by weight) (flashing point: 140° C., MORESCO WHITE P-40 (made by Matsumura Oil Research Corporation)) and zirconia beads (100 parts by weight) were mixed so as to be the toner concentration in the developer of 10% by weight, and stirred by a sand mill for 120 hours so that a developer R was obtained. The average particle size of the toner particles in the developer R was 2.7 μm.

Example 19

The polyester resin F (100 parts by weight) and copper phthalocyanine (15 parts by weight) were mixed, and further mixed by a Henschel mixer sufficiently, and after the mixture was melt-mixed by a twine-screw extrusion kneader, the resulting kneaded matter was cooled, and then coarsely pulverized. This was then finely pulverized by using a jet mill so that toner particles having an average particle size of 6 μm were obtained.

These toner particles (34 parts by weight), V-220 (made by International Specialty Products.) (0.25 parts by weight) serving as a dispersant, liquid paraffin (100 parts by weight) (flashing point: 140° C., MORESCO WHITE P-40 (made by Matsumura Oil Research Corporation.)) and zirconia beads (100 parts by weight) were mixed so as to be the toner concentration in the developer of 25% by weight, and stirred by a sand mill for 120 hours so that a developer S was obtained. The average particle size of the toner particles in the developer S was 2.9 μm.

Example 20

The polyester resin F (100 parts by weight) and copper phthalocyanine (15 parts by weight) were mixed, and further mixed by a Henschel mixer sufficiently, and after the mixture was melt-mixed by a twine-screw extrusion kneader, the resulting kneaded matter was cooled, and then coarsely pulverized. This was then finely pulverized by using a jet mill so that toner particles having an average particle size of 6 μm were obtained.

These toner particles (100 parts by weight), V-220 (made by International Specialty Products.) (0.25 parts by weight) serving as a dispersant, liquid paraffin (100 parts by weight) (flashing point: 140° C., MORESCO WHITE P-40 (made by Matsumura Oil Research Corporation.)) and zirconia beads (100 parts by weight) were mixed so as to be the toner concentration in the developer of 10% by weight, and stirred by a sand mill for 120 hours so that a developer T was obtained. The average particle size of the toner particles in developer T was 2.8 μm.

Comparative Example 1

The same processes as those of example 12 were carried out except that in place of the polyester resin G, the polyester resin H was used so that a developer U was obtained. The average particle size of the toner particles in the developer U was 2.8 μm.

Comparative Example 2

The same processes as those of example 12 were carried out except that in place of the polyester resin D, the polyester resin I was used so that a developer V was obtained. The average particle size of the toner particles in the developer V was 2.7 μm.

Comparative Example 3

The same processes as those of example 12 were carried out except that in place of the polyester resin G, the polyester resin J was used so that a developer W was obtained. The average particle size of the toner particles in the developer W was 2.6 μm.

Comparative Example 4

The same processes as those of example 16 were carried out except that in place of the polyester resin B, the polyester resin J was used, with IP2028 being used as the liquid paraffin, so that a developer X was obtained. The average particle size of the toner particles in the developer X was 2.8 μm.

Comparative Example 5

The same processes as those of example 16 were carried out except that in place of the polyester resin B, the polyester resin J was used and that 5 parts by weight of V220 was used, so that a developer Y was obtained. The average particle size of the toner particles in the developer Y was 3.1 μm.

The above-mentioned developers A to Y were subjected to actual copying tests by using a test machine of a wet image-forming apparatus, and the fixability and heat-resistant storage stability thereof were evaluated.

FIG. 1 is a schematic drawing showing one example of the structure of the test machine of a wet image-forming apparatus. On the periphery of an image-supporting member 201 having a drum shape, a charging device 203, an exposing device 204, a developing roller 103, an intermediate transfer member 301 and an image-supporting member cleaning blade 204 are respectively disposed in the order of a rotation direction indicated by an arrow, and on the periphery of the intermediate transfer member 301, a primary transfer roller 302, a belt transporting roller 305, a counter roller 306, a secondary transfer roller 307 and a tension roller 308 are disposed.

The surface of the image-supporting member 201 is uniformly charged to a predetermined surface potential by the charging device 203, and this is then subjected to an exposure corresponding to image information by the exposing device 204 so that an electrostatic latent image is formed on the surface of the image-supporting member 201. Next, the electrostatic latent image on the image-supporting member 201 is developed in a developer vessel 100 filled with a developer solution 102 containing toner particles and a carrier solution by the developing roller 103 so that a toner image is formed on the surface of the image-supporting member 201. At this time, not only the toner particles, but also the carrier solution is adhered to the surface of the image-supporting member 201. Here, this developing solution coat layer on the developing roller 103 is maintained at a predetermined thickness by a regulating blade 101.

Next, by applying a predetermined voltage to the roller 302, the toner image on the image-supporting member 201 is transferred onto the intermediate transfer member 301. The voltage having a polarity reversed to that of the toner particles is applied to the roller 302, and at this time, the voltage difference thereof from the image-supporting member is 300 V to 3 kV.

Figure 2:
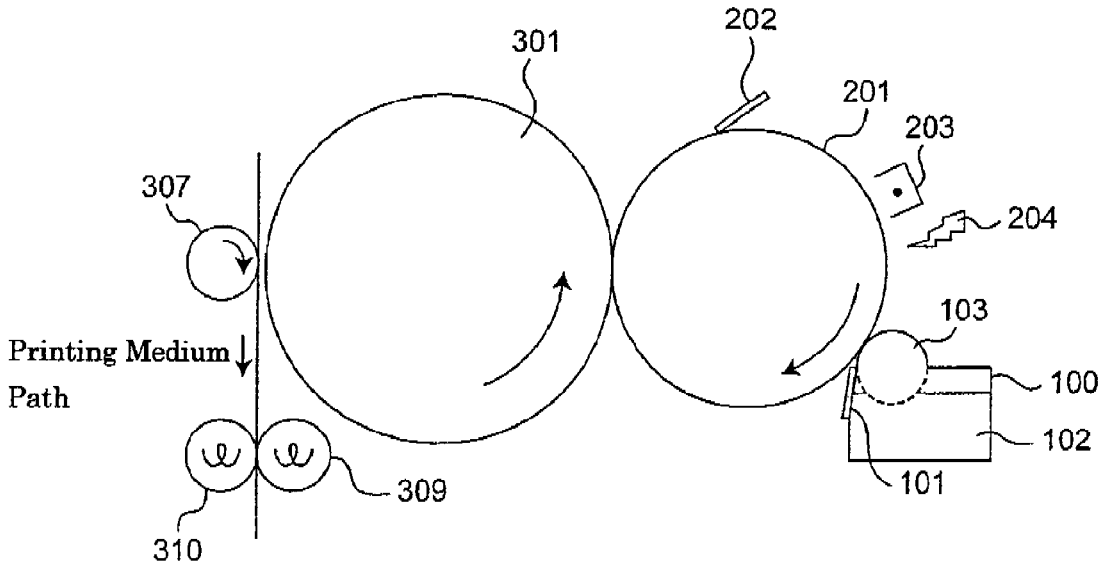
FIG. 2 is a schematic drawing showing another example of the structure of a wet image-forming apparatus.

A belt as shown in FIG. 1 and a roller as shown in FIG. 2 may be used as the intermediate transfer member 301. In a case where the belt is used as the intermediate transfer member, the belt material is composed of a resin or an elastic body, and from the viewpoint of the transferability to a rough paper, the elastic body is preferably used, and those having a heat resistant property are preferably used. The elastic body desirably has a thickness of 50 μm to 1 mm, a volume resistivity in a range from $10^6$ to $10^{12}$ Ωcm, and a surface resistivity in a range from $10^6$ to $10^{12}$Ω/. Examples of the resin include polyester, polypropylene, polyamide, polyimide, a fluorine-based resin, polyphenyl sulfate and the like, and examples of the elastic body include silicon rubber, fluororubber, EPDM, urethane rubber, nitrile rubber and the like; however, both of them are not limited thereto. From the viewpoint of safety in transportation, a multi-layered belt with an elastic body placed on a resin base is desirably used. In this case, desirably, the resin base has a thickness of 50 to 200 μm and the elastic body has a thickness of 200 μm to 1 mm. Moreover, the uppermost layer preferably has a high releasing property. For this reason, the surface layer is preferably formed by using a polymer having a low surface energy, such as a fluorine-based polymer and a silicon-based polymer, or is prepared as a hard layer having a thickness of 1 μm or less by using plasma treatment or the like.

The developer, transferred onto the intermediate transfer member, is further transferred on a printing medium in the secondary transferring units (306, 307). A voltage having a polarity reversed to that of the toner is applied to the secondary transfer roller 307. Reference numerals 309 and 310 represent heating rollers by which the toner is fixed.

(Fixability Evaluation)

A developer to be evaluated was put in the developer vessel 102, and developing and transferring conditions were adjusted such that a solid image having an amount of toner of 3 g/m$^2$ on a medium was obtained. An image sample was outputted under conditions of a system velocity of 180 mm/sec, a temperature of the heating roller of 180° C. and a NIP passage time of 40 msec.

The evaluation of the fixability was carried out by using a tape separation test (tape: 3M mending tape), and the density of the separated tape was measured, and its fixability was determined. The reflection densities before and after the tape separation were measured by using a densitometer made by X-Rite Incorporated, and when the density ratio before and after the separation was 95% or more, this state was evaluated as ◎, when the density ratio thereof was 90% or more and 95% or less, this state was evaluated as ○, and when the density ratio thereof was less than 95%, this state was evaluated as x.

(Heat-Resistant Storage Stability Evaluation)

Each of the developers was put into a glass bottle, and stored at 50° C. for 24 hours, and the particle sizes before and after the storage were measured by using a SALD-2200 made by Simadzu Corporation. When the rate of change in particle sizes (average particle size after storage/average particle size before storage) was 1.2 or less, this state was evaluated as ○, and when the rate of change exceeded 1.2, this state was evaluated as x.

(Precipitation Resistant Property Test)

Each of the wet developers obtained in examples and comparative examples was left still for one week in an environment of 25 to 30° C. Thereafter, the state of the toner in the wet developer was visually confirmed, and evaluated based upon the following criteria of four ranks.

◎: No precipitate of toner particles was found (with about less than 5% of supernatant).

○: Hardly any precipitate of toner particles was found (with about 5% to 10% of supernatant).

Δ: Slight precipitate of toner particles was found (with about 10% or more of supernatant).

x: Precipitate of toner particles was clearly found (with about 40% or more of supernatant).

(Re-Dispersibility Evaluation)

Each of the wet developers obtained in examples and comparative examples was left still for one week in an environment of 25 to 30° C. Thereafter, the state of the toner in the wet developer was visually confirmed, and evaluated based upon the following criteria of four ranks.

◎: Re-dispersed even when tilted (originally with no precipitate or the like generated).

○: Re-dispersed when shaken to be mixed.

Δ: Re-dispersed when strongly stirred by using a spatula or the like.

x: Not re-dispersed (including solidification and generation of coarse particles).

(Viscosity Measurements)

By using a rotation-type rheometer ARES-RFS made by TA instruments. Japan, the viscosity was measured on a 50 mm cone plate under a steady shear rate of 1 sec$^{-1}$ as well as under that of 1000 sec$^{-1}$. The measuring temperature was 25° C.

(Results)

The above results are shown in Table 2-1, Table 2-2, Table 3-1 and Table 3-2.

TABLE 2-1

| | Resin | | | | | | Dispersant | | Carrier | |
|---|---|---|---|---|---|---|---|---|---|---|
| | Resin | PO ratio (%) | TMA (parts) | Tg(° C.) | Acid value | Pigment | Kinds | Amount (parts) | Kinds | Flashing point (° C.) |
| Example. 1 | A | 95 | 0 | 68 | 12 | Copper phthalocyanine | V220 | 0.25 | P40 | 140 |
| Example. 2 | C | 80 | 50 | 78 | 27 | Copper phthalocyanine | V220 | 0.25 | IP2028 | 84 |
| Example. 3 | F | 60 | 0 | 79 | 38 | Copper phthalocyanine | S11200 | 0.25 | P40 | 140 |
| Example. 4 | G | 50 | 0 | 68.3 | 7 | Copper phthalocyanine | V220 | 0.25 | IP2028 | 84 |
| Example. 5 | B | 86.3 | 200 | 76 | 42 | Copper phthalocyanine | V220 | 0.5 | P40 | 140 |
| Example. 6 | E | 70 | 0 | 68 | 22 | Copper phthalocyanine | Disperbyk-109 | 0.5 | IP2028 | 84 |
| Example. 7 | G | 50 | 0 | 68.3 | 7 | Carbon black | V220 | 0.5 | P40 | 140 |
| Example. 8 | A | 95 | 0 | 68 | 12 | Copper phthalocyanine | V220 | 0.75 | IP2028 | 84 |

TABLE 2-1-continued

| | Resin | | | | | | Dispersant | | Carrier | |
|---|---|---|---|---|---|---|---|---|---|---|
| | Resin | PO ratio (%) | TMA (parts) | Tg(° C.) | Acid value | Pigment | Kinds | Amount (parts) | Kinds | Flashing point (° C.) |
| Example. 9 | F | 60 | 0 | 79 | 38 | Copper phthalocyanine | S13940 | 0.75 | P40 | 140 |
| Example. 10 | G | 50 | 0 | 68.3 | 7 | Copper phthalocyanine | V220 | 1.5 | IP2028 | 84 |
| Example. 11 | B | 86.3 | 200 | 76 | 42 | Basic copper phthalocyanine | V220 | 1.5 | P60 | 170 |
| Example. 12 | G | 50 | 0 | 68.3 | 7 | Copper phthalocyanine | S13940 | 2 | P120 | 200 |
| Example. 13 | D | 75 | 0 | 78.3 | 7 | Carbon black | S11200 | 2 | P120 | 200 |
| Example. 14 | C | 80 | 50 | 78 | 27 | Quinacridone | Disperbyk-109 | 2 | P40 | 140 |
| Example. 15 | A | 95 | 0 | 68 | 12 | Copper phthalocyanine | S13940 | 2 | P120 | 200 |
| Example. 16 | B | 86.3 | 200 | 76 | 42 | Copper phthalocyanine | V220 | 4 | P40 | 140 |
| Example. 17 | E | 70 | 0 | 68 | 22 | Carbon black | S11200 | 5 | IP2028 | 84 |
| Comparative Example. 1 | H | 100 | 0 | 55 | 8 | Copper phthalocyanine | S13940 | 2 | P120 | 200 |
| Comparative Example. 2 | I | 43.8 | 0 | 81 | 8 | Carbon black | S11200 | 2 | P120 | 200 |
| Comparative Example. 3 | J | 97.5 | 0 | 81 | 28 | Copper phthalocyanine | S13940 | 2 | P120 | 200 |
| Comparative Example. 4 | J | 97.5 | 0 | 81 | 28 | Copper phthalocyanine | V220 | 4 | IP2028 | 84 |
| Comparative Example. 5 | I | 43.8 | 0 | 81 | 8 | Copper phthalocyanine | V220 | 5 | P40 | 140 |

TABLE 2-2

| | Particle size | | Viscosity (m Pa · s) | | | Evaluation | | | |
|---|---|---|---|---|---|---|---|---|---|
| | Initial (μm) | Particle size ratio | $\eta_{1000}$ | $\eta_1$ | Viscosity ratio $\eta_1/\eta_{1000}$ | Fixability | Storage property | Precipitation resistant property | Re-dispersibility |
| Example. 1 | 2.7 | 1.19 | 79 | 3,960 | 50 | ○ | ○ | ◎ | ◎ |
| Example. 2 | 2.9 | 1.05 | 7.8 | 1,560 | 200 | ◎ | ○ | ◎ | ◎ |
| Example. 3 | 2.7 | 1.07 | 77 | 8,415 | 110 | ◎ | ○ | ◎ | ◎ |
| Example. 4 | 2.5 | 1.18 | 7.6 | 606 | 80 | ○ | ○ | ◎ | ◎ |
| Example. 5 | 2.7 | 1.10 | 72 | 3,620 | 50 | ◎ | ○ | ◎ | ◎ |
| Example. 6 | 2.8 | 1.17 | 7.1 | 385 | 54 | ◎ | ○ | ◎ | ◎ |
| Example. 7 | 2.6 | 1.14 | 70 | 3,000 | 43 | ○ | ○ | ◎ | ◎ |
| Example. 8 | 2.8 | 1.19 | 7.1 | 377 | 53 | ○ | ○ | ◎ | ◎ |
| Example. 9 | 2.6 | 1.14 | 69 | 1,580 | 23 | ◎ | ○ | ◎ | ◎ |
| Example. 10 | 2.7 | 1.13 | 6.6 | 250 | 38 | ◎ | ○ | ◎ | ◎ |
| Example. 11 | 2.4 | 1.07 | 91 | 1,640 | 18 | ◎ | ○ | ○ | ◎ |
| Example. 12 | 2.6 | 1.11 | 109 | 1,850 | 17 | ○ | ○ | ○ | ○ |
| Example. 13 | 2.9 | 1.03 | 112 | 2,130 | 19 | ◎ | ○ | ○ | ○ |
| Example. 14 | 3.1 | 0.99 | 67.5 | 945 | 14 | ◎ | ○ | ○ | ○ |
| Example. 15 | 2.7 | 1.18 | 114 | 1,370 | 12 | ○ | ○ | ○ | ○ |
| Example. 16 | 2.8 | 0.98 | 58 | 208 | 3.6 | ◎ | ○ | X | Δ |
| Example. 17 | 2.6 | 0.98 | 7.0 | 6.9 | 1.0 | ◎ | ○ | X | Δ |
| Comparative Example. 1 | 2.8 | 1.81 | 115 | 1,575 | 14 | X | X | ○ | X |
| Comparative Example. 2 | 2.7 | 1.00 | 108 | 1,324 | 12.3 | X | ○ | ○ | ○ |
| Comparative Example. 3 | 2.6 | 1.60 | 115 | 1,229 | 10.7 | X | X | ○ | ○ |
| Comparative Example. 4 | 2.8 | 1.50 | 6.8 | 6.8 | 1.0 | X | X | X | X |
| Comparative Example. 5 | 3.1 | 1.03 | 55.0 | 129.0 | 2.3 | X | ○ | X | Δ |

TABLE 3-1

| | Toner | | Resin | | | | | Dispersant | | Carrier | |
|---|---|---|---|---|---|---|---|---|---|---|---|
| | Resin | concentration (weight %) | PO ratio (%) | TMA (parts) | Tg(° C.) | Acid value | Pigment | Kinds | Amount (parts) | Kinds | Flashing point (° C.) |
| Example. 18 | F | 15 | 60 | 0 | 79 | 38 | Copper phthalocyanine | V220 | 0.25 | P40 | 140 |

TABLE 3-1-continued

| | Toner | | Resin | | | | | Dispersant | | Carrier | |
|---|---|---|---|---|---|---|---|---|---|---|---|
| | Resin | concentration (weight %) | PO ratio (%) | TMA (parts) | Tg(° C.) | Acid value | Pigment | Kinds | Amount (parts) | Kinds | Flashing point (° C.) |
| Example. 19 | F | 25 | 60 | 0 | 79 | 38 | Copper phthalocyanine | V220 | 0.25 | P40 | 140 |
| Example. 20 | F | 50 | 60 | 0 | 79 | 38 | Copper phthalocyanine | V220 | 0.25 | P40 | 140 |

TABLE 3-2

| | Particle size | | Viscosity (m Pa · s) | | | Evaluation | | | |
|---|---|---|---|---|---|---|---|---|---|
| | Initial (μm) | Particle size ratio | $\eta_{1000}$ | $\eta_1$ | Viscosity ratio $\eta_1/\eta_{1000}$ | Fixability | Storage property | Precipitation resistant property | Re-dispersibility |
| Example. 18 | 2.7 | 1.20 | 75 | 2,250 | 30 | ◎ | ○ | ◎ | ◎ |
| Example. 19 | 2.9 | 1.07 | 77 | 8,420 | 110 | ◎ | ○ | ◎ | ◎ |
| Example. 20 | 2.8 | 1.06 | 435 | 4,050,000 | 9,300 | ◎ | ○ | ◎ | ◎ |

Examples 1 to 15 as well as Examples 18 and 19, which had a ratio of PO in the alcohol component in a range from 50 to 95% and a viscosity ratio in a range from 10 to 10,000, exerted good fixability and heat-resistant storage property. Moreover, when the viscosity ratio became less than 10 as in the cases of Examples 16 and 17, a precipitate was easily generated. However, since the ratio of PO in the alcohol component was in a range from 50 to 95% so that a good re-dispersibility was obtained, a high storage property was maintained. Moreover, as in the cases of Examples 2, 5, 11, 14 and 16, when a certain amount of TMA was contained as an acid component, the fixability was further improved.

In contrast, in Comparative Examples 1, 3 and 4 in which the PO rate in the alcohol component exceeded 95%, both of the fixability and the heat-resistant storage property were lowered. Moreover, in Comparative Examples 2 and 5 in which the PO rate in the alcohol component was less than 5%, the fixability was insufficient, although the storage property was good. However, in Comparative Examples 1 to 3, since the viscosity ratio was high with a high thixotropic property, the precipitation resistance was improved. In contrast, in Comparative Examples 4 and 5, since the thixotropic property was low, a precipitate was generated. In particular, in Comparative Example 5 having a PO ratio of 97.5% exceeding 95%, any of the fixability, storage property, precipitation resistant property and re-dispersibility were lowered.

Table 3-2 shows influences by the toner concentration. In a case where the rate of PO in the alcohol component was from 50 to 95%, with the viscosity ratio being 10 to 10,000, any of the fixability, storage property, precipitation resistant property and re-dispersibility were good, even when the toner concentration was made higher up to 50% by weight.

What is claimed is:

1. A wet developer comprising toner particles composed of at least a colorant and a binder resin, which are dispersed in a non-volatile carrier solution by using a dispersant, wherein the binder resin is a polyester resin having an alcohol component which contains a mixture of an ethylene oxide adduct of bisphenol A and a propylene oxide adduct of bisphenol A, with a ratio thereof being 1:19 to 10:10 (weight ratio).

2. The wet developer according to claim 1, which has a viscosity ratio ($\eta_1/\eta_{1000}$) between viscosity $\eta_1$ at the time of a steady shear rate of 1 $sec^{-1}$ and viscosity $\eta_{1000}$ at the time of a steady shear rate of 1000 $sec^{-1}$ in a range from 10 to 10,000.

3. The wet developer according to claim 1, wherein the dispersant is a polymer dispersant having a basic group.

4. The wet developer according to claim 1, wherein the polymer dispersant has at least one kind of basic group selected from the group consisting of an amide group, a methylol group, a pyridine group, a pyrrolidone group, an imidazole group, an imine group and an amino group.

5. The wet developer according to claim 1, wherein the polyester resin has a glass transition temperature of 60° C. or more.

* * * * *